United States Patent [19]

Wolf

[11] 4,432,382

[45] Feb. 21, 1984

[54] TENT STAKE

[76] Inventor: Jerrold M. Wolf, 4880 Dogwood Ave., Seal Beach, Calif. 90740

[21] Appl. No.: 361,439

[22] Filed: Mar. 24, 1982

[51] Int. Cl.[3] ..... A45F 1/16; A45F 1/18

[52] U.S. Cl. ..... 135/118; 119/121; D30/44; 135/119

[58] Field of Search ..... 135/118, 119, 87, 120; 119/121; 172/24; 52/155, 4, 3; D30/44; D21/255; 47/26, 32; 273/26 E, 58 C; 24/129 C, 131 C, 265 CD

[56] References Cited

U.S. PATENT DOCUMENTS

| | | | |
|---|---|---|---|
| 1,089,803 | 3/1914 | Wellman | 135/118 |
| 3,724,034 | 4/1973 | Osano | 24/131 C |
| 3,804,409 | 4/1974 | Schachner | 273/58 C |

*Primary Examiner*—Richard J. Apley
*Assistant Examiner*—Stephen R. Crow
*Attorney, Agent, or Firm*—Allan M. Shapiro

[57] ABSTRACT

Tent stake has a straight wire shank and has a head formed of the same material. The head has a hook under the side thereof for engagement by a tent rope, has a driving surface on the top thereof, and has an opening therethrough to serve as a handle for the pulling of the tent stake.

12 Claims, 4 Drawing Figures

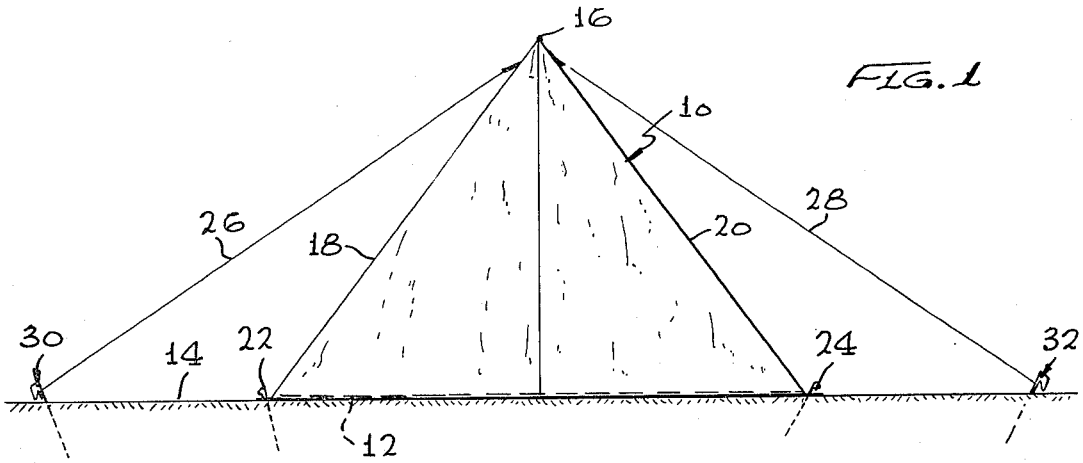
FIG. 1
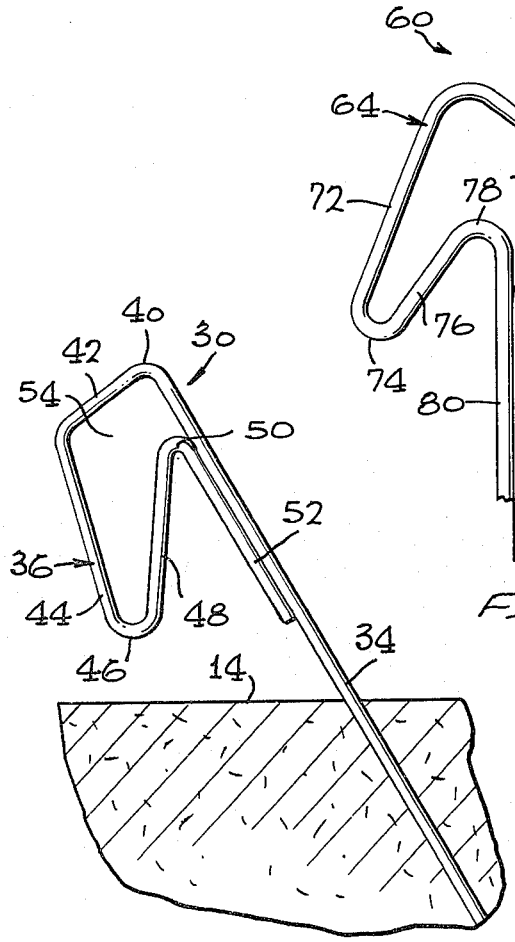
FIG. 2
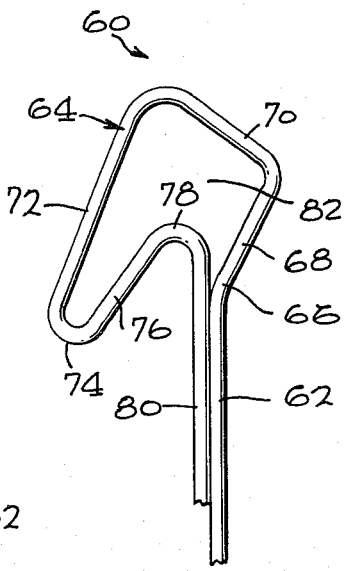
FIG. 4
FIG. 3
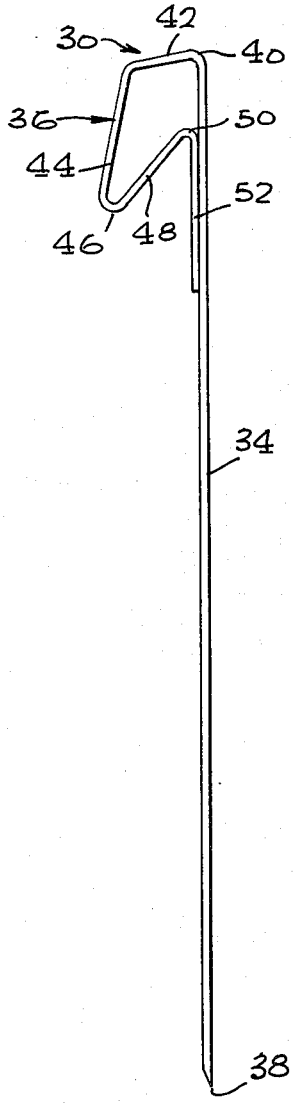

TENT STAKE

BACKGROUND OF THE INVENTION

This invention is directed to a tent stake, and particularly a tent stake designed for easy installation and removal, together with secure tent rope attachment.

When tents are used, quite often tent ropes are necessary to maintain the tent in the upright, erected position. In addition, the corners of the tent floor must be staked down in order to provide tent stability. In some installations, tent stakes are only necessary around the tent floor; in those tents the structural design is such that the sides, and perhaps tent poles, perform all of the stability functions. It is more usual, however, that a tent require the securement of ropes to maintain the ridge line taut, or to stabilize the tent poles against swaying. When tent ropes must be secured, stakes are often employed. The desirable feature of tent stakes is that they be easily installed, secure for tent rope attachment, and easily removed. In addition, it is desirable that they be light in weight so that they do not unnecessarily add to the total structural weight which must be transported when the tent is moved.

Thus, there is need for an improved tent stake design which meets these criteria.

SUMMARY OF THE DISCLOSURE

In order to aid in the understanding of this invention it can be stated in essentially summary form that it is directed to a tent stake which is formed of a single length of wire-like material. The shank of the stake is formed of a straight section of the wire and the head is formed by bending the wire to present a driving surface in line with the shank, and to form a hook and an open handle, respectively, for tent rope engagement and tent stake removal. Below the hook, the bent end of the wire is preferably secured to the shank.

It is thus an object of this invention to provide a tent stake which is of economical manufacture and convenient use, so that it can be widely and easily used. It is a further object to provide a tent stake made of a single length of wire-like material having a straight shank and a bent head thereon, with the head being for driving of the tent stake, tent rope attachment and tent stake withdrawal.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

BRIEF DESCRIPTION OF THE DRAWINGS

FIG. 1 is an end elevational view of a tent, showing the manner in which the tent stake of this invention is employed to support and stabilize the tent.

FIG. 2 is an enlarged view showing the tent stake of this invention, in its first preferred embodiment, as installed, with parts broken away.

FIG. 3 is a side elevational view of the tent stake of FIG. 2.

FIG. 4 is a side elevational view of the second preferred embodiment of the tent stake of this invention, with the shank thereof broken away.

DESCRIPTION OF THE PREFERRED EMBODIMENTS

Tent 10 has a floor 12 on the ground 14 and has peak 16 supported above the ground by poles. Tent sides 18 and 20 stabilize the peak as long as the floor is well secured. Tent stakes 22 and 24 are positioned through rings secured to the edges of the floor fabric to stretch out the floor 12 and secure it to the ground. Some tents are secured in this way. Other tents have tent ropes 26 and 28 attached to the peak and extending either along the length of the peak to keep it taut, or at an angle thereto to stabilize the position of peak 16, or both. The tent ropes must be secured to the ground, and tent stakes 30 and 32 are employed for that purpose. When the tent stakes 30 and 32 are secured in the ground, the tent ropes are engaged thereon and tightened in the usual way. Tent stakes 30 and 32 are of identical construction. Tent stakes 22 and 24 are also of identical construction and may be identical to the tent stake 30, being of the same size or possibly a slightly smaller size, as indicated in FIG. 1. Aside from the size, the remainder of the configuration of tent stake 22 is the same as tent stake 30.

Tent stake 30 is shown in more detail in FIGS. 2 and 3. Tent stake 30 is made of a single piece of wire-like material, preferably circular in cross-section, so that the wire is a solid cylinder. Steel is a suitable material for the wire which forms the body of the tent stake. In this sense, the body is the entire length of the wire including the shank 34 of tent stake 30 and the head 36. The shank is straight and extends from the tip 38 to the striking corner 40 of the head. Striking corner 40 is in line with the straight shank 34 and the bend at striking corner 40 is preferably slightly greater than 90°, as shown in FIGS. 2 and 3. From the bend at striking corner 40 the top 42 extends away from the center line of the straight shank 34. Downward leg 44 is directed at an acute angle with respect to straight shank 34 and is directed away from the straight shank in a downward direction. At the lower end of downward leg 44, hook bend 46 directs the body upward in hook leg 48, which is directed at an acute angle with respect to the center axis of straight shank 34. The hook leg 48 is acute in the same direction as downward leg 44. Final bend 50 directs the final leg 52 parallel to and in contact with the upper portion of straight shank 34. The final leg 52 may be attached to the shank 34 by any appropriate means, such as spot welding.

Another preferred embodiment of the tent stake of this invention is generally indicated at 60 in FIG. 4. The tent stake 60 has the same characteristics, including a body which is of wire-like material. The body includes straight shank 62 which is shown broken off in FIG. 4. Its length is actually the same proportionate length as is shown in FIG. 3. Head 64 of the tent stake is formed by bending the upper end of the body above straight shank 62. In tent stake 60, the head starts at bend 66 to form an offset leg 68 which is at an acute angle with respect to the upward extension of the actual center line of the straight shank 62. Top 70 and downward leg 72 are both angularly oriented with respect to the axial center line. Hook bend 74 directs hook leg 76 at an acute angle with respect to the center line of straight leg 62, while final bend 78 brings final leg 80 down next to straight shank 62 to which it is preferably fastened, as by spot welding. Opening 82 in head 64 permits access by the user's fingers. Like stake 30, stake 60 has all of its bends and legs lying in a single plane. The stake 60 is easier to use in lighter soils because it is easy to manually engage and thrust into such lighter soil.

The body of tent stake 30 is sufficiently stiff that in use it can be driven into the ground. The tent stake is aligned in the position where it is to be driven and a driving force is applied to striking corner 40. If the soil is light, such as sand or sandy loam, quite often the tent stake 30 can be installed simply by hand force on the top 42, with the hand force principally aligned and with shank 34 by applying the hand force at striking corner 40. The manual effort will be enough to install the stake 30 in light soil, particularly because of the thinness of shank 34, which need not displace much soil upon its entry. Even in light soil, the stake 30 can hold a substantial force, particularly when the tent stake 30 is installed with its shank axis approximately at right angles to the force which is expected to be applied. If necessary, particularly in heavier soils, the driving force applied to striking corner 40 may be applied with a hammer, axe, rock, or a block of wood, depending upon the available tools. In that case, the stake 30 may be used in heavier soils.

Stakes 22 and 24 may be the same in size as stake 30 or may be of a smaller size, with the same proportions. Stakes 22 and 24 are driven into the rings at the edges of the tent floor. Stakes 30 and 32 are driven into the soil at the selected locations and orientations, and thereafter the tent ropes 26 and 28 are tied thereto, respectively. The tent ropes are engaged within the hook of the tent stake and appropriately tied, usually back to themselves. In this way, the tent is secured.

When the tent is being taken down, the tent stakes must be removed. The opening 54 in the head 36 is large enough to accept at least several fingers of the user's hand. The user then pulls the tent stake out of the soil by applying manual force to the head by finger engagement in opening 54, with the withdrawal force being directed axially of shank 34. Thus, the tent stake 30, and its companions can be readily withdrawn. Accordingly, the tent stake 30 and its companions are inexpensive to manufacture, are light weight for easy transportation, and yet have a strong head 36 for the driving, the tying to and the withdrawal of stake 30.

This invention has been described in its presently contemplated best mode, and it is clear that it is susceptible to numerous modifications, modes, and embodiments within the ability of those skilled in the art and without the exercise of the inventive faculty. Accordingly, the scope of this invention is defined by the scope of the following claims.

I claim:

1. A tent stake, said tent stake having a body of elongated wire-like metal having a uniform cross section, said tent stake body having a straight, elongated shank for earth engagement, said shank having a tip on one end of said body, said body having a head thereon at the end of said straight shank opposite said tip, said straight shank terminating at a striking corner where said shank joins said head, said head being formed of a top leg directed away from said straight shank at the bend at said striking corner, said top leg being directed at an acute angle with respect to said straight shank, a downwardly extending leg attached to said top leg at a bend therebetween, said downwardly extending leg being oriented at an acute angle with respect to said straight shank, a hook bend formed on said body between said downwardly extending leg and a hook leg on the side of said hook bend away from said downwardly extending leg, said hook leg extending at an acute angle with respect to said straight shank, said head including a final leg on said body beyond said hook leg, a final bend in said body between said hook leg and said final leg so that a hook is formed between said hook leg and said final leg, said final leg lying against at least a portion of said straight shank.

2. The tent stake of claim 1 wherein said final leg is secured to said straight shank.

3. The tent stake of claim 2 wherein said final leg is secured to said straight shank by spot welding.

4. The tent stake of claim 1 wherein said legs and said head in said straight shank substantially lie in a single plane.

5. A tent stake, said tent stake having a body of elongated wire-like metal having a uniform cross section, said tent stake body having a straight, elongated shank for earth engagement, said shank having a tip on one end of said body, said body having a head thereon at the end of said straight shank opposite said tip, said head including a top leg contiguous with said straight shank, a hook bend formed on said body, said hook bend having a hook leg on one side thereof, said hook leg extending at an acute angle with respect to said straight shank, a downwardly extending leg between said top leg and said hook leg, said downwardly extending leg being oriented at an acute angle with respect to said straight shank said head including a final leg on said body beyond said hook bend, a final bend in said body between said hook leg and said final leg so that a hook is formed between said hook leg and said final leg, said final leg lying parallel along at least a portion of said straight shank.

6. The tent stake of claim 5 wherein said legs and said head and said straight shank substantially lie in a single plane.

7. A tent stake comprising:

a body of elongated wire-like material having a uniform cross section, said body of said tent stake having a straight, elongated shank for earth engagement, said shank having a tip on one end of said body;

a head unitary with said body at the end of said straight shank opposite said tip, said head having a striking corner formed as a bend in said body at the end of said straight shank said body extending from said striking corner to a hook bend, said head having a hook leg adjacent said hook bend on the side thereof toward said striking corner and a final bend adjacent said hook leg, a final leg on the other side of said final bend, said final leg lying against said straight shank, said hook lying at an acute angle to said final leg and said shank to form a hook in said head, said head being formed so that there is an opening therein at least sufficiently large to accept at least several fingers for handling of said tent stake.

8. The tent stake of claim 7 wherein said final leg is secured to said straight shank.

9. The tent stake of claim 8 wherein said final leg is secured to said straight shank by spot welding.

10. The tent stake of claim 7 wherein said head and said straight shank substantially lie in a single plane.

11. The tent stake of claim 7 wherein there is at least one leg between said striking corner and said hook bend, said at least one leg lying at an acute angle with respect to said shank.

12. The tent stake of claim 11 wherein there is a top leg and a downwardly extending leg between said striking corner and said hook bend, and both said top leg and said downwardly extending leg extend at an acute angle with respect to said shank.

* * * * *